US006571911B2

(12) United States Patent
Watanabe et al.

(10) Patent No.: US 6,571,911 B2
(45) Date of Patent: Jun. 3, 2003

(54) MUFFLER FOR AN ENGINE

(75) Inventors: Satoshi Watanabe, Saitama (JP); Shigeru Furudate, Saitama (JP); Tsuyoshi Ishii, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 55 days.

(21) Appl. No.: 09/956,923

(22) Filed: Sep. 21, 2001

(65) Prior Publication Data

US 2002/0033304 A1 Mar. 21, 2002

(30) Foreign Application Priority Data

Sep. 21, 2000 (JP) ..... 2000-287000

(51) Int. Cl.[7] ..... F01N 1/08

(52) U.S. Cl. ..... 181/265; 181/272; 181/282

(58) Field of Search ..... 181/265, 272, 181/282, 269, 273, 276

(56) References Cited

U.S. PATENT DOCUMENTS

| | | | | |
|---|---|---|---|---|
| 2,182,405 A | * | 12/1939 | Noblitt et al. | 181/265 |
| 2,998,093 A | * | 8/1961 | Powers | 181/265 |
| 4,381,045 A | | 4/1983 | Buchwalder | |

FOREIGN PATENT DOCUMENTS

| | | | |
|---|---|---|---|
| GB | 1412404 | 11/1975 | |
| GB | 1448301 | 9/1976 | |
| JP | 55-59119 | 10/1953 | |
| JP | 2-41293 | 10/1990 | F01N/7/00 |

* cited by examiner

*Primary Examiner*—Khanh Dang
(74) *Attorney, Agent, or Firm*—Sughrue Mion, PLLC

(57) ABSTRACT

A muffler including a long outlet pipe 20 having an exhaust gas inlet pipe portion 21, a return pipe portion 22, an exhaust gas outlet pipe portion 23, and two turnaround pipes 24, 25 for connecting the three pipe portions 21, 22, 23 together in series. These pipe portions 21, 22, 23 are arranged in parallel with one another along a longitudinal direction of a shell 2, and in such a manner that longitudinal axes 21L, 22L, 23L of the pipe portions are positioned at respective vertices of a triangle.

3 Claims, 6 Drawing Sheets

MUFFLER FOR AN ENGINE

BACKGROUND OF THE INVENTION

1. Field of the Invention

The present invention relates to a muffler adapted to be connected to an exhaust system of an engine, and more particularly to a muffler suitable for an automotive engine by enhancing the noise reduction effect while avoiding enlargement and flattening of the muffler's shell.

2. Description of the Related Art

A conventional muffler, connected to an exhaust system of an automotive engine, includes an inlet pipe, an outlet pipe, and an expansion chamber. The inlet pipe is continuously connected to an exhaust pipe from the engine, whereas the outlet pipe is open to the atmosphere. The expansion chamber provides communication between the inlet pipe and the outlet pipe. It is known that extending the length of the muffler's outlet pipe enhances the noise reduction effect on the exhaust noise. If the outlet pipe simply is extended, however, then a downstream portion of the outlet pipe—or a tail pipe—largely extends rearward from a shell of the muffler. If one attempts to apply such a muffler—with the outlet pipe so extended—to an engine of an automobile, then there is a risk that the tail pipe may interfere with a device of the automobile, such as the automobile's rear bumper. Thus, space for the muffler is limited, whereby it is difficult to extend the outlet pipe outwardly from the muffler's shell.

To cope with this, there have been proposed ways for extending the outlet pipe within the shell. For example, well known are: disposing an outlet pipe in a U-shaped fashion within a shell (refer to JP-A-55-59119U); and disposing an outlet pipe in an S-shaped fashion within a shell (JP-B-2-41293U).

When an outlet pipe is extended within a shell of a muffler as described above, however, the diameter of the muffler increases. More particularly, when the outlet pipe is S-shaped within the shell, as is the case with the aforesaid conventional example, the respective straight pipe portions of the outlet pipe are disposed in the same plane. Therefore, a diameter of the shell of the muffler—in the direction of the plane in which the pipe portions are disposed—increases. Accordingly, the shell of the muffler is flatter, which leads to the reduction of rigidity in the face of the shell, and which causes problems such as: necessity of a separate reinforcement means; and the shell of the muffler becomes lager in size.

SUMMARY OF THE INVENTION

The present invention was made in view of the foregoing situations, and a primary object thereof is to provide a novel muffler that can solve the aforesaid problems by improving the construction of an outlet pipe disposed in the muffler's shell.

With a view to attaining the above and other objects, according to a first aspect of the invention, there is provided a muffler, for an engine, comprising:

a shell;

an inlet pipe provided in said shell and connected to an exhaust pipe from said engine; and an outlet pipe provided in said shell, and open to the atmosphere, said outlet pipe including:

three linear pipe portions defining an exhaust gas inlet pipe portion, an exhaust gas return pipe portion, and an exhaust gas outlet pipe portion; and two turnaround pipe portions that are curved so as to connect said linear pipe portions to each other in series, wherein said exhaust gas inlet pipe portion, said exhaust gas return pipe portion, and said exhaust gas outlet pipe portion, are disposed in parallel with each other along a longitudinal direction of said shell, further wherein longitudinal axes of said three linear pipe portions are positioned on respective vertices of a triangle, and further wherein said exhaust gas inlet pipe portion is disposed adjacent to a bottom portion of said shell.

According to such construction, there is no need to make the shell of the muffler flatter and larger, and water remaining trapped in the muffler shell easily is drained therefrom.

In addition, according to a second aspect of the invention, there is provided a muffler for an engine as set forth in the first aspect of the invention, wherein exhaust noise interference holes are formed in an upper area of an intermediate portion of the outlet pipe, whereby the holes open the interior of the outlet pipe to the interior of the shell. Accordingly, there is no need to make the shell of the muffler flatter and larger, and water remaining trapped in the muffler shell easily can be drained therefrom. In addition, the resonance of exhaust noise within the outlet pipe effectively can be prevented. Moreover, there is no risk of water remaining trapped in the outlet pipe and returning to the shell through the exhaust noise interference holes.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A mode for carrying out the invention will be described below based on an embodiment shown in the appended drawings.

Figure 1:
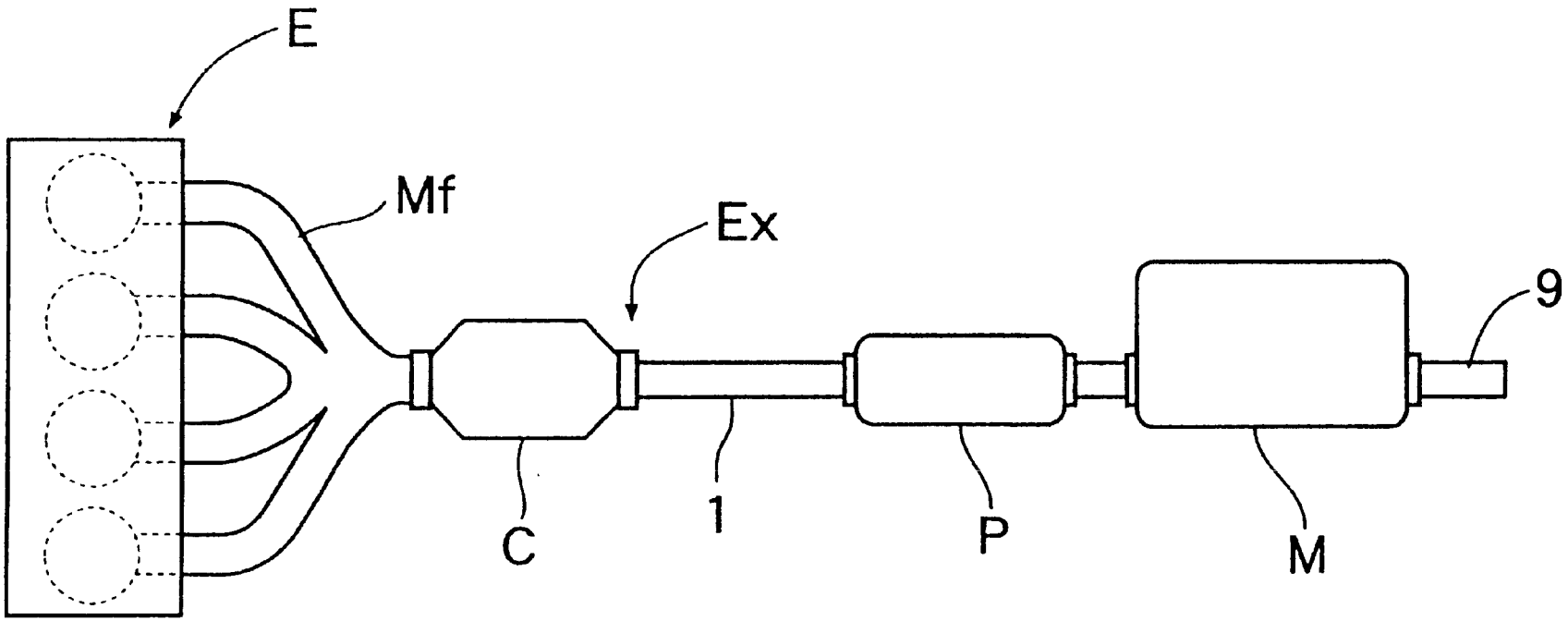
FIG. 1 is a schematic plan view of an exhaust system of an engine provided with a muffler according to the invention.

An embodiment will be described in which a muffler of the invention is applied to an exhaust system of an engine for an automobile. In FIG. 1, an exhaust system Ex is connected to an engine of an automobile, wherein reference character E denotes the engine as a whole. The exhaust system Ex discharges exhaust gases, produced by the operation of the engine, into the air. The exhaust system Ex includes an exhaust manifold Mf coupled to exhaust ports of the engine E, an exhaust pipe 1 connected to a downstream end of the exhaust manifold Mf, a catalytic converter C, a pre-chamber P and a muffler M. The last three components are connected to the exhaust pipe 1 in that order from upstream side to downstream side.

Figure 3:
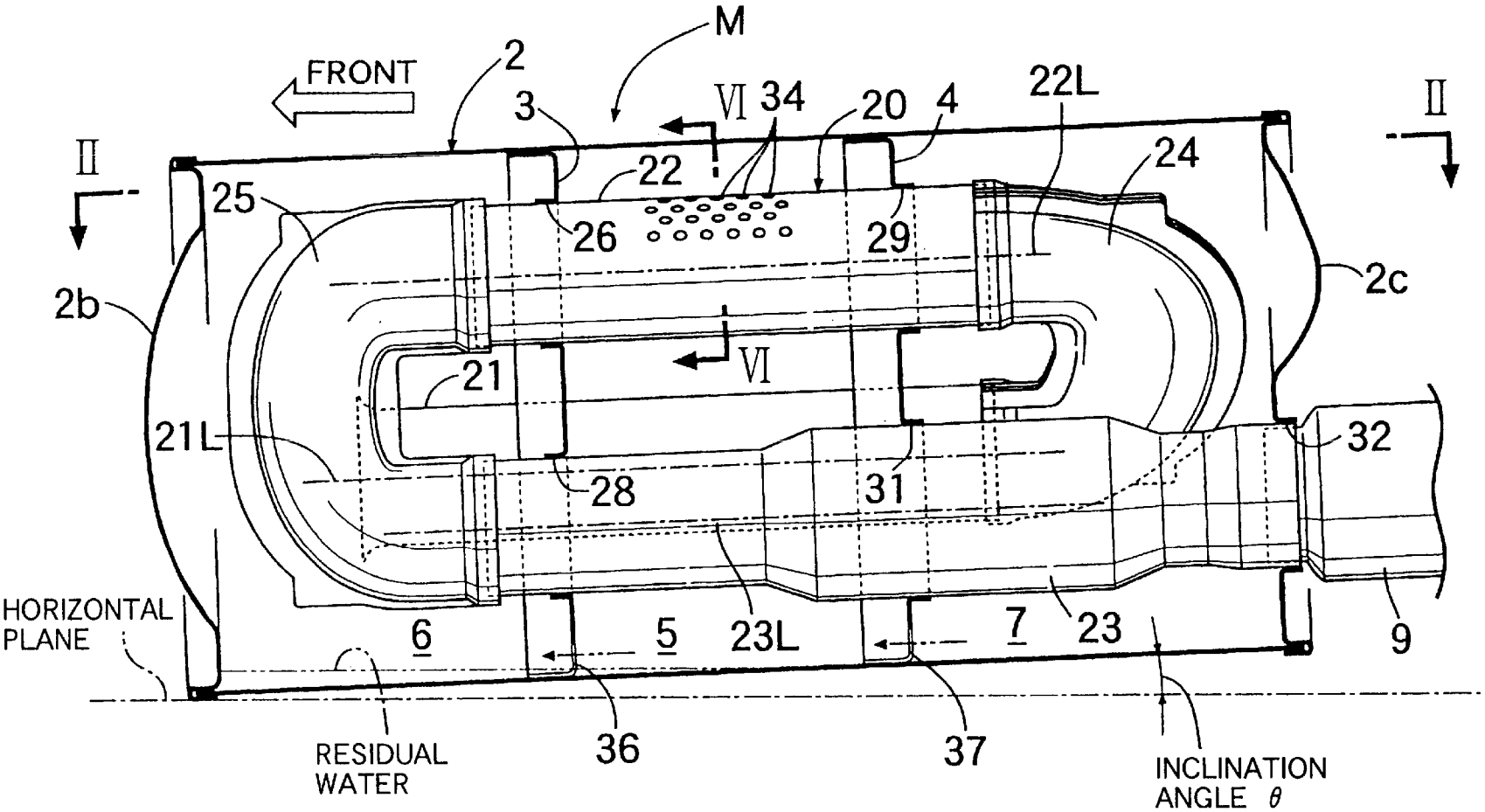
FIG. 3 is a cross-sectional view taken along the line III—III of FIG. 2.

When the exhaust system Ex is connected to the engine E, a muffler shell 2 is disposed at an angle of inclination θ relative to the horizontal plane so that the shell 2 takes a slightly forwardly inclined posture, as shown in FIG. 3. Accordingly, water remaining trapped within the shell 2 (as described in detail later) is collected at a front portion thereof.

Exhaust gases, produced from the engine E when it is in operation, flow to the catalytic converter C where harmful constituents of the gases are purified. Then, as the gasses flow further through the exhaust system Ex, the noise of the exhaust gases primarily is reduced at the pre-chamber P, and then secondarily is reduced at the muffler M, before the gases are discharged into the atmosphere.

Next, the construction of the muffler M, which is a main focus of the invention, will be described in detail with reference to FIGS. 1 to 6.

The shell 2, comprising a casing of the muffler M, is formed into a closed hollow oval cylinder. The shell 2 includes a shell main body 2*a*, as well as front and rear end plates 2*b*, 2*c*. The main body 2*a* is formed by curvedly bending a stainless sheet into an oval cylinder, and integrally joining ends of the stainless sheet so bent. The front and rear end plates 2*b*, 2*c* are air-tightly caulk-fitted in left and right open ends of the shell main body 2*a*. This oval cylindrical shell 2 is connected to a downstream portion of the exhaust pipe 1 with a minor axis side thereof being oriented in a vertical direction. Air-tightly connected to the front end plate 2*b* and rear end plate 2*c* of the shell 2 are, respectively, the exhaust pipe 1 connected to the pre-chamber P, and a tail pipe 9 that is open to the atmosphere.

A first partition plate 3, and a second partition plate 4, are securely fixed in the shell 2 at a certain interval in the longitudinal direction of the shell 2, wherein the plates are substantially parallel with the front and rear end plates 2*b*, 2*c*. Thus, the interior of the shell 2 is partitioned into a first expansion chamber 5, a second expansion chamber 6, and a resonance chamber 7. The first expansion chamber 5 is formed in a longitudinal intermediate portion of the shell 2 by the first partition plate 3 and the second partition plate 4. The second expansion chamber 6 is formed ahead of the first expansion chamber 5 by the front end plate 2*b* and the first partition plate 3. And the resonance chamber 7 is formed rearward of the first expansion chamber 5 by the second partition wall 4 and the rear end plate 2*c*.

Figure 4:
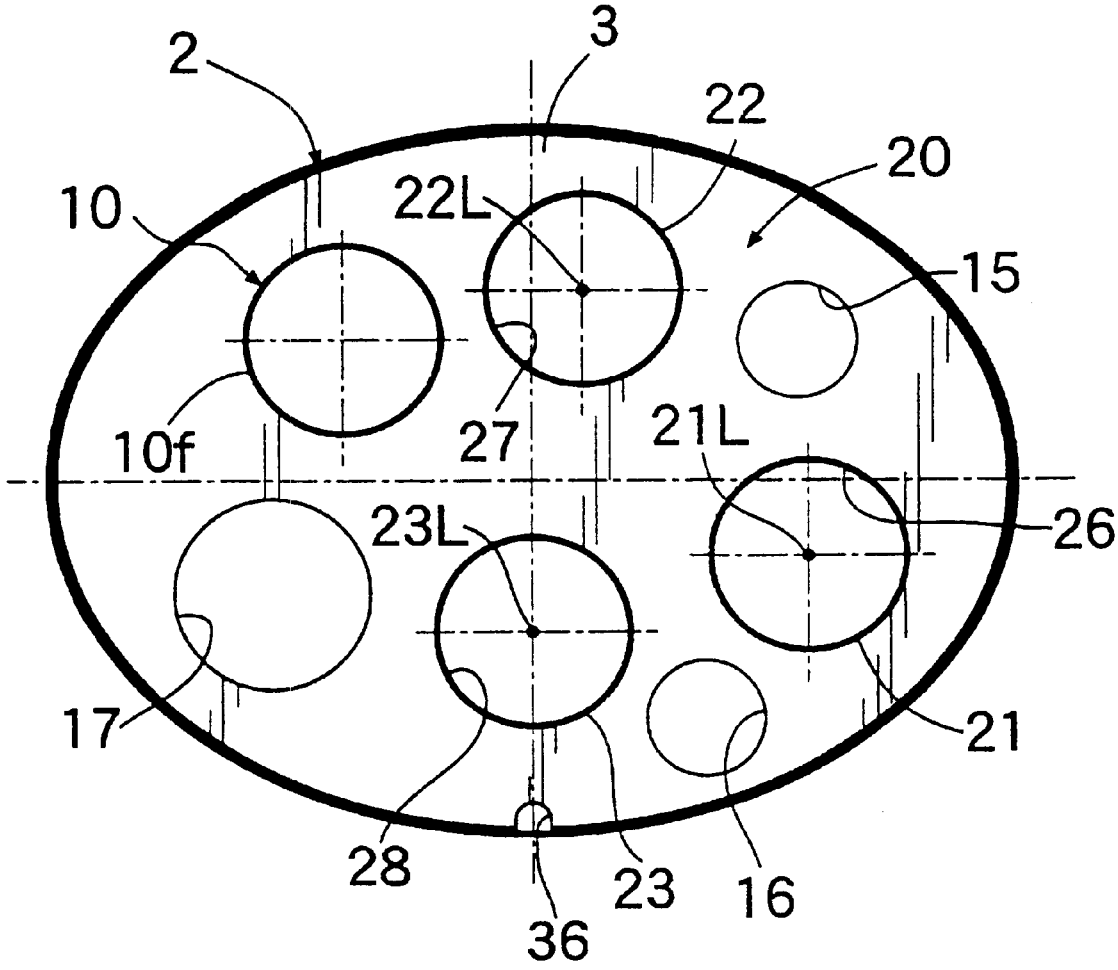
FIG. 4 is a cross-sectional view taken along the line IV—IV of FIG. 2.
Figure 5:
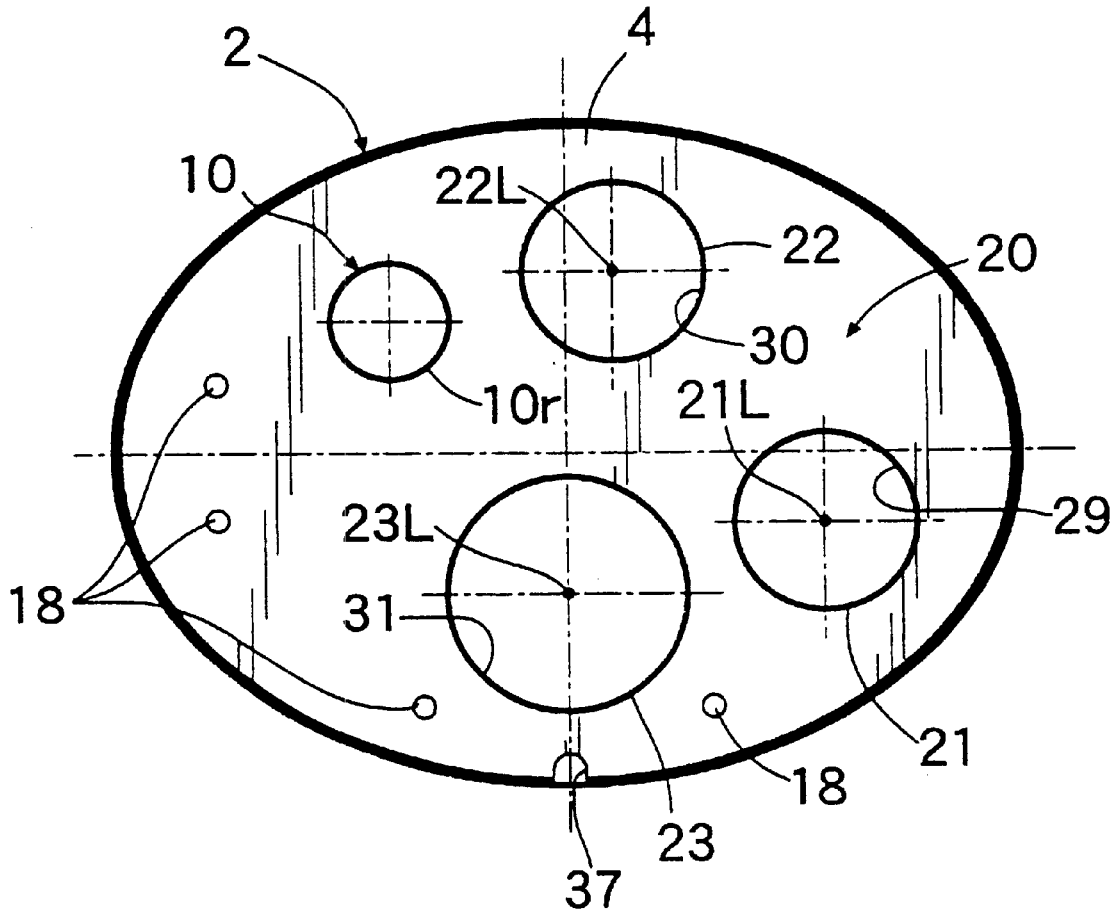
FIG. 5 is a cross-sectional view taken along the line V—V of FIG. 2.
Figure 6:
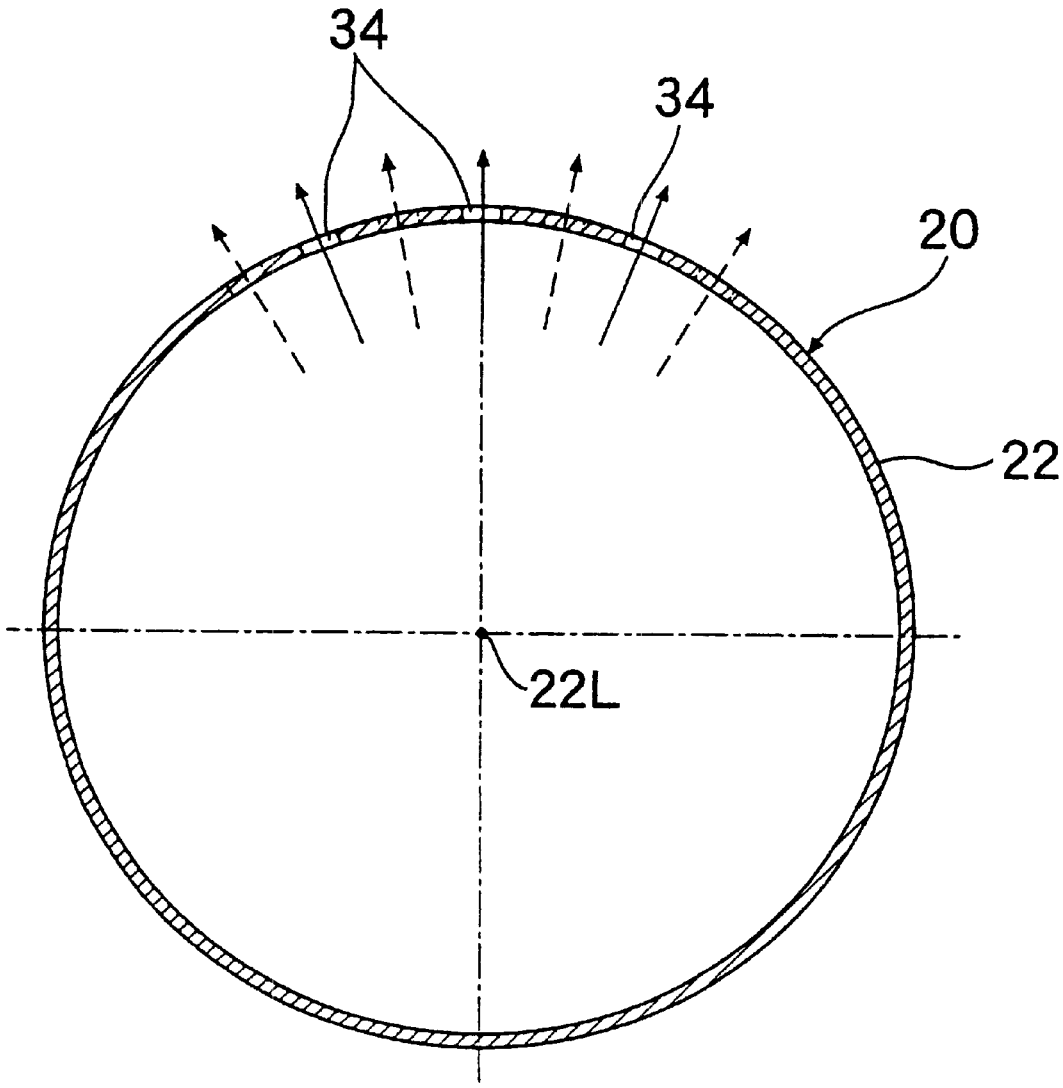
FIG. 6 is a cross-sectional view taken along the line VI—VI of FIG. 3.

As shown in FIG. 4, a plurality of communicating holes 15, 16, 17 are opened in the first partition plate 3 so that the holes are spaced apart from one other. The first expansion chamber 5 and the second expansion chamber 6 communicate with each other via these communicating holes 15, 16, 17. In addition, as shown in FIG. 5, a plurality of small holes 18 is opened in the second partition plate 4, whereby the first expansion chamber 5 and the resonance chamber 7 communicate with each other via these small holes 18.

Figure 2:
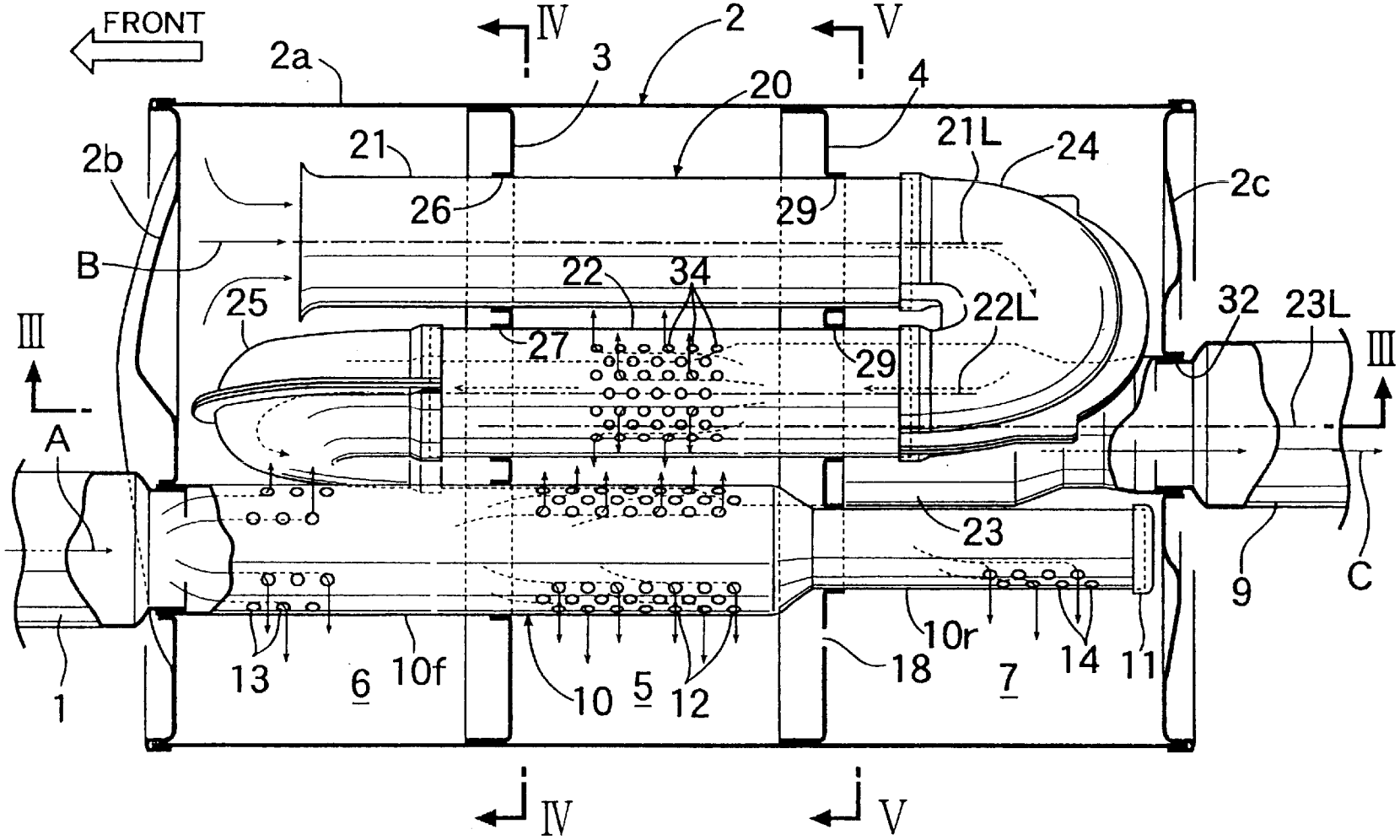
FIG. 2 is a horizontal cross-sectional view of the muffler, as taken along the line II—II of FIG. 3.

As shown in FIG. 2, a front end (an upstream end) of an inlet pipe 10—disposed within the shell 2—is connected to a rear end (a downstream end) of the exhaust pipe 1 so as to communicate therewith. This inlet pipe 10 is linearly formed along its full length, and extends longitudinally within the shell 2. The inlet pipe 10 is supported by the front end plate 2*b*, the first partition plate 3, and the second partition plate 4. A rear portion 10*r*, of the inlet pipe 10, is located in the resonance chamber 7 and is formed smaller in diameter than a front portion 10*f*, which is located in the first and second expansion chambers 5, 6. In addition, a rear end of the inlet pipe 10 is closed with a cap 11. A plurality of small exhaust holes 12 is disposed in a portion of the inlet pipe 10 that confronts the first expansion chamber 5, whereby the interior of the inlet pipe 10 communicates with the interior of the first expansion chamber 5 via these exhaust holes 12. In addition, a plurality of small exhaust holes 13 is disposed in a portion of the inlet pipe 10 that confronts the second expansion chamber 6, whereby the interior of the inlet pipe 10 communicates with the interior of the second expansion chamber 6 via these exhaust holes 13. Furthermore, a plurality of small exhaust holes 14 is disposed in a portion of the inlet pipe 10 that confronts the resonance chamber 7, whereby the interior of the inlet pipe 10 communicates with the interior of the resonance chamber 7 via these exhaust holes 14.

Consequently, exhaust gases flowing from the exhaust pipe 1 into the inlet pipe 10 enter the first and second expansion chambers 5, 6 through the exhaust holes 12, 13. Further, part of the exhaust gases flowing into the inlet pipe 10 also enters the resonance chamber 7 via the exhaust holes 14. Therefore, exhaust vibration is damped out by virtue of expansion and resonance actions of the exhaust gases, whereby a primary noise reduction is implemented. Then, the exhaust gases discharged from the inlet pipe 10 flow into the second expansion chamber 6 and thereafter enter an outlet pipe 20 (which will be described later), where a secondary noise reduction effectively is implemented.

The outlet pipe 20 is disposed in parallel with the inlet pipe 10 within the shell 2. As a whole, this outlet pipe 20 is long and bends in an S-shape fashion along the longitudinal direction of the shell 2. The outlet pipe 20 includes an exhaust gas inlet pipe portion 21, a return pipe portion 22, an exhaust gas outlet pipe portion 23—wherein each of the pipe portions 21, 22, 23 is linear—an upstream side turnaround pipe portion 24, and a downstream side turnaround pipe portion 25, wherein the turnaround pipe portions 24 and 25 connect the linear pipe portions 21, 22, 23 together as a single pipe. The outlet pipe 20 thus bends twice.

The linear exhaust gas inlet pipe portion 21 is disposed at a bottom portion in the shell 2, on one side thereof, in parallel with the axis of the shell 2. Further, the exhaust gas inlet pipe portion 21 is supported by supporting holes 26 and 29 that extend through the first and second partition walls 3, 4. A front end (an upstream end in this instance) of the gas inlet pipe portion 21 is flared open within the second expansion chamber 6, whereas a rear end (a downstream end in this instance) thereof is located within the resonance chamber 7 for connection to the upstream side turnaround pipe portion 24. As will be described later, because this exhaust gas inlet pipe portion 21 is disposed at the bottom portion in the shell 2, it effectively works to introduce water, which remained in the shell 2, into the outlet pipe 20.

The return pipe portion 22 is disposed at an upper portion of the shell 2, and centrally in the lateral direction of the shell 2. Further, the return pipe portion 22 is disposed in parallel with the axis of the shell 2, and is supported by supporting holes 27 and 30 that extend through the first and second partition plates 3 and 4. A rear end (an upstream end in this instance) of the return pipe portion 22 is located in the resonance chamber 7 for connection to the upstream side turnaround pipe portion 24, whereas a front end (a downstream end in this instance) thereof is located in the second expansion chamber 6 for connection to the downstream side turnaround pipe portion 25.

Furthermore, the exhaust gas outlet pipe portion 23 is disposed at a lower portion in the shell 2, and centrally in the lateral direction of the shell 2. Also, the exhaust gas outlet pipe portion 23 is disposed in parallel with the axis of the shell 2, and is supported by supporting holes 28, 31 and 32 that extend through the first and second partition plates 3, 4 as well as through the rear end plate 2*c*. A front end (an upstream end in this instance) of the exhaust gas outlet pipe portion 23 is located in the second expansion chamber 6 for connection to the downstream side turnaround pipe portion 25, whereas a rear end (a downstream end in this instance) thereof is connected to the tail pipe 9 so as to be open to the atmosphere.

As shown in FIGS. 4, 5, the three pipe portions constituting the outlet pipe 20—namely, the exhaust gas inlet pipe portion 21, the return pipe portion 22, and the exhaust gas outlet portion 23—are substantially parallel with one another and are disposed in parallel along the longitudinal direction of the shell 2 in such a manner that longitudinal axes 21L, 22L, 23L of the respective pipe portions 21, 22, 23 are positioned at vertices of a triangle. Disposing the outlet pipe 20 as described above contributes to the miniaturization of the shell 2 by reducing vertical and/or horizontal space occupied by the outlet pipe 20 within the shell 2.

A plurality of small exhaust-noise-interference holes 34 is disposed in an intermediate portion of the outlet pipe 20. Specifically, in this embodiment, the holes 34 are disposed in an upper area of the return pipe portion 22, in the longitudinal portion thereof that confronts the first expansion chamber 5. As will be described in detail later, these exhaust-noise-interference holes 34 function to effectively prevent the noisy resonance of exhaust gases flowing through the long outlet pipe 20.

As shown in FIG. 3, water communication holes 36, 37 are provided in lowest portions of the first and second partition plates 3, 4. The water communication holes 36, 37 establish a communication between the portions ahead and rearward of the first partition wall 3 and the second partition wall 4, respectively. Further, due to the water communication holes 36, 37, and to the slightly forward inclined posture of the shell (as described above), water remaining in the shell 2 is collected in the front portion of the shell so that it can be drained out through the outlet pipe 20.

Next, an operation of this embodiment will be described.

As the engine z operates, exhaust gases produced by the engine are introduced into the exhaust system Ex. The exhaust gases flowing through the exhaust system Ex eventually enter the muffler M, where the noise of the exhaust gases is mainly reduced.

As shown by an arrow A in FIG. 2, exhaust gases flowing from the exhaust pipe 1 into the inlet pipe 10 enter the first expansion chamber 5 and the second expansion chamber 6 through the exhaust holes 12 and the exhaust holes 13. Further, part of the exhaust gases enters the resonance chamber 7 through the exhaust holes 14. Thus, the noise of the exhaust gases primarily is reduced by effectively damping out the exhaust gas vibration energy through the compound action of expansion and resonance of the exhaust gases.

The exhaust gases within the resonance chamber 7 enter the first expansion chamber 5 through the small communication holes 18. And the exhaust gases within the first expansion chamber 5 enter the second expansion chamber 6 through the communicating holes 15, 16, 17 that extend through the first partition plate 3. Then, the exhaust gases so entering the second expansion chamber 6, and the exhaust gases which have already entered the same chamber via holes 13, get together and flow into the outlet pipe 20 from the open end of the exhaust gas inlet pipe portion 21 as indicated by an arrow B in FIG. 2. Thus, as has been described before, since this outlet pipe 20 is long and bends in an S-shaped fashion, the noise of the exhaust gases in the outlet pipe 20 is reduced further by flowing through the outlet pipe 20. The noise reduction provided by the outlet pipe 20 is a secondary noise reduction. Then, after sufficient noise reduction, the exhaust gases are discharged from the rear end of the exhaust gas outlet pipe portion 23 into the tail pipe 9 so as to be discharged into the atmosphere as indicated by an arrow C in FIG. 2.

In order to enhance the noise reduction efficiency, the outlet pipe 20 is constructed so as to be long while bending in an S-shaped fashion. However, the exhaust gas inlet pipe portion 21, the return pipe portion 22, and the exhaust gas outlet pipe portion 23—which constitute the main part of the outlet pipe 20—are arranged in parallel with one another along the longitudinal direction of the shell 2 so that the axes 21L, 22L, 23L of the pipe portions 21, 22, 23 are located at the vertices of the triangle, whereby it is possible to prevent weakness caused by a shell 2 which is made flat, and to prevent an increase in the size of the shell 2.

In addition, although residual water is collected in the shell 2, it is collected at the front lower portion of the shell 2 due to the water communication holes 37, 36 that extend through the lowest portions of the second and first partition plates 4, 3, and due to the forward inclined posture of the shell 2. Then, the residual water so collected is drained to the atmosphere from the open end of the exhaust gas inlet pipe portion 21 via the outlet pipe 20. That is, and as this occurs, since the exhaust gas inlet pipe portion 21 is located close to the bottom portion of the shell 2, the residual water in the shell 2 can be drained advantageously.

The residual water is water collected in the shell when exhaust gases at high temperatures are cooled within the shell 2 and condense. Alternatively, the residual water may come from water that enters the shell 2 from the outlet pipe 20 and tail pipe 9 when washing the car.

Further, although the exhaust noise reduction effect can be improved by extending the outlet pipe 20, the extension of the outlet pipe 20 facilitates the generation of a resonance of exhaust-gas noise vibrations within the outlet pipe 20. And the generation of such a resonance may lead to a risk that a sufficient exhaust noise reduction effect cannot be attained. To cope with this, the exhaust noise interference holes 34 are formed in the intermediate portion of the outlet pipe 20—or, more specifically, in the return pipe portion 22 in this embodiment—so that exhaust gases which do not pass through the exhaust gas inlet pipe portion 21, and which have different frequencies whose phases are acoustically shifted, are allowed to interfere with the exhaust gases passing through the outlet pipe 20 substantially at the central portion of the outlet pipe 20. Thusly, the generation of such a resonance of exhaust noise in the outlet pipe 20 effectively is prevented. In addition, since the exhaust noise interference holes 34 are formed in the upper area of the return pipe portion 22, there is no risk that residual water in the muffler M passes through the exhaust-noise-interference holes 34 during the process of draining the residual water to the outside of the muffler M via the outlet pipe 20. Therefore, it is ensured that the residual water can be drained from the outlet pipe 20.

Thus, while the invention has been described based on an embodiment thereof, the invention is not limited thereto but a variety of embodiments can be made without departing from the scope of the invention.

For example, although the return pipe portion is disposed at the upper portion in the shell, and the exhaust gas outlet pipe portion is disposed therebelow (in the aforesaid embodiment), the exhaust gas outlet pipe portion may be disposed at the upper portion in the shell with the return pipe portion being disposed therebelow. In addition, although the exhaust noise interference holes are formed in the upper portion of the return pipe portion, similar holes may be formed in the upper portion of any other portions of the outlet pipe 20, provided that those portions are located at an intermediate portion of the outlet pipe 20.

As has been described heretofore, according to the first aspect of the invention, since the exhaust gas inlet pipe portion, the return pipe portion and the exhaust gas outlet pipe portion—which together constitute the outlet pipe—are arranged in parallel with one another along the longitudinal direction of the muffler shell in such a manner that the longitudinal axes of those pipes are positioned at the vertices of a triangle, the problem of the shell being made flatter and larger can be eliminated. Further, since the exhaust gas inlet pipe portion is disposed close to the bottom portion of the shell, the residual water in the muffler can advantageously be drained.

In addition, with a view to attaining the objects of the invention, according to the second aspect of the invention, exhaust noise interference holes are formed in the upper portion of an intermediate portion of the outlet pipe. Therefore, the generation of a resonance of exhaust noise in the outlet pipe can effectively be prevented. Moreover, there is no risk of preventing the residual water from being drained to the atmosphere.

What is claimed is:

1. A muffler for an engine, comprising:

a shell;

an inlet pipe provided in said shell and connected to an exhaust pipe from said engine; and an outlet pipe provided in said shell, and open to the atmosphere, said outlet pipe including:

three linear pipe portions defining an exhaust gas inlet pipe portion, an exhaust gas return pipe portion, and an exhaust gas outlet pipe portion; and two turnaround pipe portions that are curved so as to connect said linear pipe portions to each other in series, wherein said exhaust gas inlet pipe portion, said exhaust gas return pipe portion, and said exhaust gas outlet pipe portion, are disposed in parallel with each other along a longitudinal direction of said shell, further wherein longitudinal axes of said three linear pipe portions are positioned on respective vertices of a triangle, and further wherein said exhaust gas inlet pipe portion is disposed adjacent to a bottom portion of said shell.

2. The muffler as set forth in claim 1, wherein exhaust noise interference holes are formed in an upper area of an intermediate portion of said outlet pipe, and are formed in such a manner as to communicate an interior of said outlet pipe with the interior of said shell.

3. The muffler as set forth in claim 1, further comprising expansion chambers formed in said shell, wherein said inlet pipe and said outlet pipe communicate with said expansion chambers, and further wherein exhaust gas from said engine is introduced into said expansion chambers via said inlet pipe, and said exhaust gas so introduced is then discharged out of said expansion chambers to the atmosphere via said outlet pipe.

* * * * *